United States Patent [19]

Yoshida et al.

[11] Patent Number: 4,464,059

[45] Date of Patent: Aug. 7, 1984

[54] SPEECH SYNTHESIZER TIMEPIECE WITH ADVANCE ANNOUNCEMENT

[75] Inventors: Kunio Yoshida; Yutaka Ikemoto, both of Nara, Japan

[73] Assignee: Sharp Kabushiki Kaisha, Osaka, Japan

[21] Appl. No.: 316,402

[22] Filed: Oct. 29, 1981

[30] Foreign Application Priority Data

Oct. 29, 1980 [JP] Japan ..... 55-152932
Oct. 29, 1980 [JP] Japan ..... 55-152933

[51] Int. Cl.[3] ..... G04C 21/14
[52] U.S. Cl. ..... 368/63; 368/73; 368/75
[58] Field of Search ..... 368/243, 244, 246, 248, 368/251, 63, 75, 73

[56] References Cited

U.S. PATENT DOCUMENTS 4,255,803 3/1981 Sekine ..... 368/243
4,279,030 7/1981 Masuzawa et al. ..... 368/63

*Primary Examiner*—Forester W. Isen
*Attorney, Agent, or Firm*—Birch, Stewart, Kolasch & Birch

[57] ABSTRACT

In a preferred aspect of the present invention, there is provided a speech synthesizer timepiece with an alarm function or a remaining interval counting function. The timepiece is adapted to set advance announcements at different intervals depending upon the length of a remaining time with respect to an intended time, the intervals being increasingly shorter as the intended time is approached. The remaining time is audibly announced each time the advance announcements are to be delivered.

5 Claims, 2 Drawing Figures

SPEECH SYNTHESIZER TIMEPIECE WITH ADVANCE ANNOUNCEMENT

BACKGROUND OF THE INVENTION

This invention relates to an improvement in a speech synthesizer timepiece having an alarm function or a remaining interval counting function and is more particularly concerned with a speech synthesizer timepiece which provides an advance announcement before an alarm time or a time setting is reached.

In the past, speech synthesizer timepieces having an alarm function or a remaining interval counting function were proposed but were able to announce no more than the arrival of time settings. Therefore, the user learned suddenly that an alarm time or a time setting had just been reached. However, in the case where the user should make preparations before the arrival of such times or have a limited share in time as in a meeting or conference, it is very convenient that he should know in advance how many hours or minutes there are until such a time is reached.

OBJECT AND SUMMARY OF THE INVENTION

Accordingly, it is an object of the present invention to provide a speech synthesizer timepiece which overcomes the above-described inconvenience by providing an advance annoucement of how many hours or minutes there are until a time setting is reached and providing such advance announcement at increasingly shorter intervals, the closer the time comes to the time setting.

In a preferred embodiment of the present invention, there is provided a speech synthesizer timepiece with an alarm function or a remaining interval counting function which comprises means for setting advance announcements at different intervals depending upon the length of time remaining with respect to an intended time, said interval being increasingly shorter as the intended time is approached, and means for announcing the remaining time each time said advance announcements are to be delivered.

BRIEF DESCRIPTION OF THE DRAWING

For a more complete understanding of the present invention and for further objects and advantages thereof, reference is now made to the following description taken in conjunction with the accompanying drawing, in which.

DETAILED DESCRIPTION OF THE INVENTION

Figure 1:
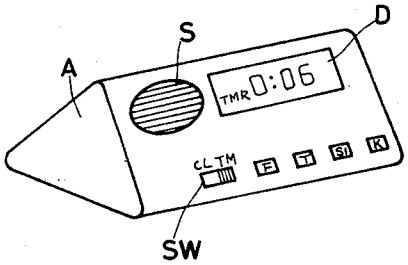
FIG. 1 is a perspective view of the appearance of a speech synthesizer timepiece constructed in accordance with a preferred embodiment of the present invention.

FIG. 1 is a perspective view of a speech synthesizer timepiece with a remaining time counting function, which includes a display (D), a speaker (S), a timepiece/remaining time mode selector (SW), a fast forward key (F), a timer start key (T), a time setting key ($S_1$) and a real time announcement key (K) in place in a main body (A).

Figure 2:
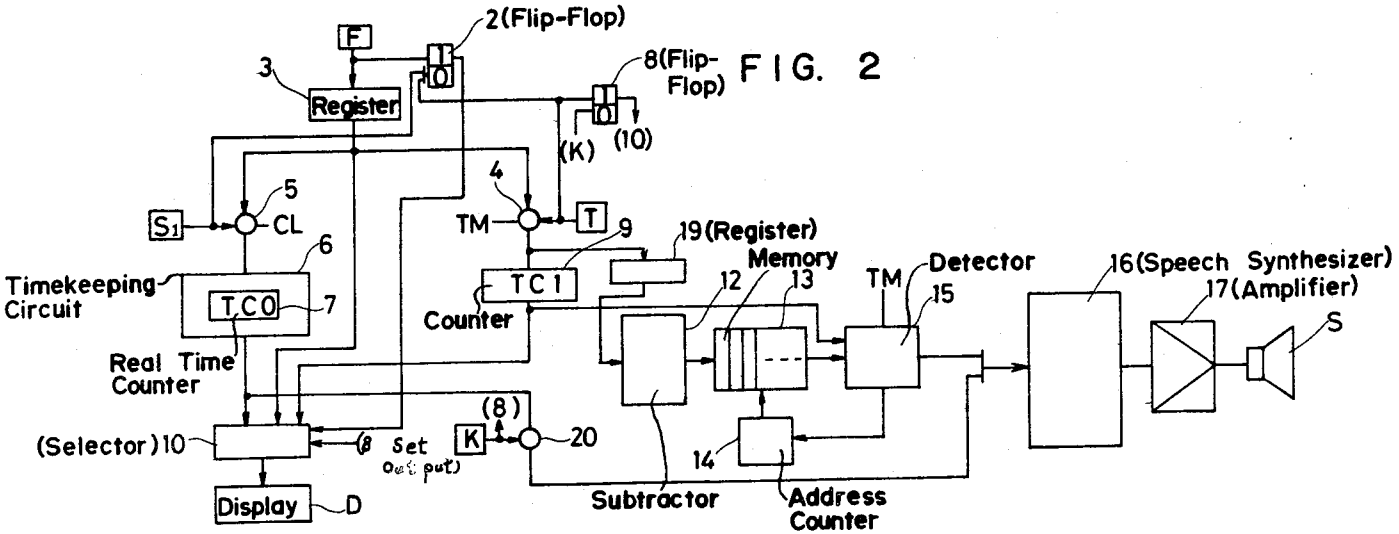
FIG. 2 is a block diagram of the above illustrated embodiment.

In the block diagram of FIG. 2, there is illustrated a speech synthesizer timepiece having a register (3) for storing temporarily updated time or a remaining period in the timer, a timekeeping circuit (6), a decrementing counter (9) for the timer, a selector circuit (10) through which the contents of the register (3), the timekeeping circuit (6) or the decrementing counter (9) are supplied selectively to the display (D), an advance announcement interval memory (13) for storing announcement intervals as determined by the remaining time in the timer, a detector circuit (15) for determining whether the contents of the store memory (13) are in agreement with that of the decrementing counter (9), and a speech synthesizer (16) for supplying audio signals to a loudspeaker (S) upon receipt of the output of the detector (15) or the output of the timekeeping circuit (6).

The contents of the register (3) are preset by the fast forward key (F). When the mode switch (SW) is turned to the timepiece mode (CL) and the time set key ($S_1$) is depressed, a gate (5) is placed in the open position so that the contents of the register (3) are fed to a real time counter (7) in the timekeeping circuit (6). When the mode select switch (SW) is turned to the remaining timer side (TM) and the timer start key (T) is depressed, another gate (4) is placed into its open position so that the contents of the register (3) are fed to the decrementing counter (9) and a second register (19) to store the remaining time.

Based upon the contents of the register (19), announcement intervals are calculated and determined through operation of a subtractor (12). The advance announcement intervals so calculated are supplied to the advance announcement interval storage memory (13).

The detector (15) works when the mode selector switch (SW) is turned to the remaining time side (TM) and especially supplies an enabling signal to the speech synthesizer (16) and to an address counter when the output of the decrementing counter (9) agrees with the contents of the advance announcement storage memory (13) at its specific address as selected by an address counter (14). The address counter (14) indicates an address for an area storing the next advance announcement interval. Obviously, the output of the speech synthesizer (16) is supplied to the loudspeaker (S) through an amplifier (17).

Upon actuation of the real time announcement key (K), a gate (20) is opened so that real time information ($TC_0$) contained in the real time counter (7) of the timekeeping circuit (6) is fed to the speech synthesizer (16).

Through combinations of the outputs of two flip-flops (2) and (8) the selector circuit (10) connects selectively one of the register (3), the real time counter (7) and the decrementing counter (9) to the display (D) as depicted in Table 1.

TABLE 1

| F/F (2) OUTPUT | F/F (8) OUTPUT | SELECT |
|---|---|---|
| 0 | 0 | $TC_0$ |
| 0 | 1 | $TC_1$ |
| 1 | 0 | COUNTER (3) |

The output signal of the flip flop (2) is held at a "1" level and at a "0" level, respectively, when the fast forward key (F) is depressed and when either the time set key ($S_1$) or the timer start key (T) is depressed. The equivalent of the flip-flop (8) is held at a "1" level when the timer start key (T) is depressed and reset to a "0" level when the real time announcement key (K) is depressed.

The above-described speech synthesizer timepiece operates in the following manner. As long as no key signal is applied externally, the display (D) is supplied with the real time information ($TC_0$) in the real time counter (7) in the timekeeping circuit (6) and thus displays the real time. Upon actuation of the real time announcement key (K), the gate (20) is placed into its open position so that the real time information ($TC_0$) is supplied to the speech synthesizer (16), thus providing an audible indication of the real time.

When a time adjustment is desired, the fast forward key (F) is actuated to place the contents of the register (3) into exact agreement with correct updated time and the mode select switch (SW) is turned to the timepiece side (CL). Upon subsequent actuation of the time set key ($S_1$) the contents of the register (3) are supplied to the real time counter (7) in the timekeeping circuit (6), thus completing the time adjustment.

When the fast forward key (F) is depressed, the contents of the register (3) are displayed visually on the display (D). After the mode select switch (SW) is actuated and the time set key ($S_1$) is depressed, the contents of the real time counter (7) ar displayed visually on the display (D).

When the remaining time function is desired, the fast forward key (F) is depressed to set a desired interval of time in the register (3). Setting is easy at this time because the contents of the register (3) are displayed visually on the display (D). When the mode select switch (SW) is turned to the remaining time side (TM) and the timer start key (T) is depressed, the contents of the register (3) are transferred to the decrementing counter (9) and the remaining interval storage register (9).

Subtraction is effected on the contents of the register (19) through the subtractor (12), with the results thereof being stored in the advance announcement interval storage memory (13). The address counter (14) indicates addresses for a first piece of the information stored.

The contents of the decrementing counter (9) are decremented with the passage of time and show the remaining interval as being displayed visually on the display (D).

If the contents of the decrementing counter (9) agree with the first of the advance announcement intervals in the advance announcement interval storage memory (13), then a signal is outputted via the detector (15), supplying the sound signal to the speech synthesizer (16) for the purpose of deliverying an audible indication of the remaining interval through the speaker (S).

Thereafter, the address counter (14) specifies addresses for the second piece of the information stored and, when the contents of the decrementing counter (9) come into agreement with the second piece of the information with the passage of time, an audible indication of the current remaining interval is delivered from the speaker. When the remaining time interval reduces to "0" through repetition of the above-described procedure, it is announced to the user that the scheduled time setting has reached.

It is obvious from the foregoing that information characteristic of the advance announcement intervals is stored initially at the longest interval and then gradually at shorter ones when the scheduled time setting is approached. Table 2 indicates this relationship.

TABLE 2

| | with a time setting of 1 hour | |
|---|---|---|
| | COUNTER (9) | AUDIBLE MESSAGE |
| (1) | 60 min | "start" |

TABLE 2-continued

| | with a time setting of 1 hour | |
|---|---|---|
| | COUNTER (9) | AUDIBLE MESSAGE |
| (2) | 45 min | "it's 45 min to go" |
| (3) | 30 min | "it's 30 min to go" |
| (4) | 15 min | "it's 15 min to go" |
| (5) | 10 min | "it's 10 min to go" |
| (6) | 5 min | "it's 5 min to go" |
| (7) | 3 min | "it's 3 min to go" |
| (8) | 1 min | "it's 1 min to go" |
| (9) | 0 min | "it's time" |

In other words, the advance announcements are located every 15 minutes in lines (1) through (4), every 5 minutes in lines (4) through (6), every 2 minutes in lines (6) through (8) and at 1 minute between lines (8) and (9).

While the speech synthesizer timepiece with the remaining time counter function has been described and illustrated, it is obvious that the present invention is equally applicable to a speech synthesizer timepiece with an alarm function. It is further apparent to those skilled in the art that various changes and modifications may be made therein without departing from the spirit and scope of the invention as claimed.

What is claimed is:

1. A speech synthesizer timepiece capable of providing an audible alarm at a selectable time and providing audible advance announcement of time remaining before the selectable time, the timepiece comprising
   - a digital timepiece circuit including a display,
   - alarm setting means for entering and storing the selectable time,
   - computation and memory means responsive to the alarm setting means for computing and storing a plurality of advance announcements at differing intervals of time before the selectable time, the differing intervals being progressively shorter with the passage of time toward the selectable time,
   - detection means responsive to the alarm setting means and the computation and memory means for detecting when each successive one of the stored advance announcement times is reached, and
   - speech generation means responsive to the detection means for generating a speech synthesized audible output announcing the remaining time before the selectable time at each of the progressively shorter intervals.

2. A speech synthesizer timepiece according to claim 1, wherein the display is capable of displaying the time remaining at any time prior to the selectable time.

3. A speech synthesizer timepiece according to claim 2, wherein the alarm setting means includes a first register means for storing a remaining period of time before the selectable time, a decrementing counter means responsive to the first register for counting down the remaining period of time and supplying a first signal indicative thereof to the detection means, and wherein the computation and memory means includes a second register means to which the remaining time is shifted from the first register, subtractor means responsive to the second register means for determining the advance announcement intervals applicable to the remaining time, and an advance announcement storage memory means responsive to the subtractor means for storing the applicable advance announcement intervals and supplying a second signal indicative of the next such advance announcement to the detection means so that the detection means detects correspondence between the remaining time period signal and the next advance announcement signal.

4. A speech synthesizer timepiece according to claim 3, wherein there is further included an address counter means responsive to the detection means for successively addressing each succeeding advance announcement in the advance announcement storage memory means.

5. A speech synthesizer timepiece according to claim 4, wherein there is further included switching means responsive to the digital timepiece circuit for causing the speech generation means to generate speech synthesized audible output announcing of real time.

* * * * *